United States Patent [19]

Brigham et al.

[11] Patent Number: 4,519,213

[45] Date of Patent: May 28, 1985

[54] AMBIENT AIR HEATED ELECTRICALLY ASSISTED CRYOGEN VAPORIZER

[75] Inventors: William D. Brigham, Huntington Beach; Nguyen D. Dung, Fullerton, both of Calif.

[73] Assignee: Zwick Energy Research Organization, Inc., Huntington Beach, Calif.

[21] Appl. No.: 519,113

[22] Filed: Aug. 1, 1983

[51] Int. Cl.[3] ..... F17C 7/02

[52] U.S. Cl. ..... 62/52; 62/434

[58] Field of Search ..... 62/52, 53, 434

[56] References Cited

U.S. PATENT DOCUMENTS

| | | | |
|---|---|---|---|
| 3,675,436 | 7/1972 | Ganiaris | 62/52 |
| 3,827,247 | 8/1974 | Kojima et al. | 62/52 |
| 4,331,129 | 5/1982 | Hong et al. | 65/52 |

*Primary Examiner*—Ronald C. Capossela

*Attorney, Agent, or Firm*—Natan Epstein; Dan Dawes; Mario Martella

[57] ABSTRACT

A high volume cryogen vaporizer includes a radiator where a working fluid draws heat from ambient air for vaporizing a cryogen in a heat exchanger. An electrical heater is provided for periodically heating the working fluid to defrost the radiator, thereby allowing sustained operation of the vaporizer. When not required for defrosting the radiator, the heater may be operated to heat a working fluid in a circuit separate from that of the radiator, and in which the heated working fluid is used for further elevating the temperature of the vaporized cryogen in a second heat exchanger, thereby making possible a gas output temperature higher than ambient air temperature.

21 Claims, 2 Drawing Figures

$LN_2$ IN FROM TANK
$GN_2$ OUT
$GN_2$ TO TANK
$LN_2$ IN FROM TANK
$GN_2$ ACCUMULATOR
TC
TC

AMBIENT AIR HEATED ELECTRICALLY ASSISTED CRYOGEN VAPORIZER

BACKGROUND OF THE INVENTION

1. Field of the Invention

The present invention relates to methods and apparatus for vaporizing cryogens and is more particularly directed to methods and apparatus for vaporizing large quantities of liquid nitrogen by drawing a maximum amount of the required heat from ambient air.

2. State of the Prior Art

Nitrogen gas is used in great quantities in connection with the drilling and extraction of underground oil and gas deposits, among many other applications. Such drilling often takes place in remote areas where power is only available from electrical generators at the drilling site. This is particularly true of ocean floor drilling where platforms are anchored far away from land power lines or other sources of energy necessary for the vaporization of large volumes of nitrogen used in the oil drilling and extraction process.

One approach to minimizing the energy input to a nitrogen vaporizer is to utilize the heat available from ambient air. This can be accomplished by passing the liquid nitrogen through a suitably constructed heat exchanger, e.g., a length of tubing provided with fins extending therefrom. In Such devices the tubing is in direct contact with the liquid nitrogen which is at a temperature of minus 320° F. As a result, humidity present in the air condenses on the very cold outer surface of the heat exchanger fins and freezes in the form of a layer of frost covering the heat exchanger surface. This covering of frost can build-up rapidly so that within a short period of time, e.g., 15 to 20 minutes, the performance of the vaporizer is seriously degraded. This type of vaporizer is nonetheless useful in applications where relatively small volumes of gas are required from time to time. While air heated large volume nitrogen vaporizers of the direct contact type have been built, i.e., where the cryogen carrying conduits are directly heated by ambient air through suitable heat exchanger fins or the like, the size of the required heat exchanger structures makes such vaporizers too large for convenient transport and use in many applications.

Therefore, for longer periods of use or greater volumes of gas in ambient air heated vaporizers, it has been necessary to resort to heating devices such as electrical resistance heaters for melting the frost on the heat exchanger to enable continued operation of the vaporizer. This is a brute force approach to overcoming the basic shortcoming of the vaporizer and is wasteful of energy. The energy cost of such a vaporizer where large volumes of nitrogen are required as in oil drilling, are prohibitive for locations such as ocean drilling platforms, particularly in severe climates such as the North Sea.

While other approaches to the problem of vaporizing large quantities of liquid nitrogen are known, such as the use of the heat generated by diesel engines, boilers, etc . . . , no truly effective and efficient means is known for constructing and operating a large volume vaporizer of reasonable physical size with a limited amount of electrical power such as may be available from a generator on an ocean drilling platform while relying primarily on ambient air heating.

SUMMARY OF THE INVENTION

The present invention overcomes the shortcomings of the prior art by providing a method and apparatus for vaporizing large volumes of nitrogen by drawing heat from ambient air even under severe climactic condition and utilizing a limited amount of electrical power on an "as needed" basis for defrosting the heat exchanger in an energy-efficient manner and also to assist the vaporizing process and to obtain a gas output of the vaporizer which is at a substantially constant temperature regardless of ambient temperature, even if the ambient temperature is considerably below the desired gas output temperature.

In a presently preferred embodiment, the vaporizer comprises a first loop in which a working fluid is circulated through a radiator for absorbing heat from ambient air and then passes through a first heat exchanger where the working fluid transfers heat to a cryogen to thereby vaporize the liquified gas. The working fluid in the first loop is below 32° F. due to thermal contact with the cryogen in the heat exchanger and is thus too cold to melt frost build up on thee radiator. A reservoir normally closed off from the first loop contains a volume of working fluid which is heated by suitable heater means such as an electric heateer maintained at a predetermined elevated temperature. In the event that defrosting of the radiator is required, the reservoir is connected by means of suitable valving with the first loop so that the heated working fluid stored in the reservoir is discharged through the radiator, heating the radiator conduits and thereby melting the frost build-up. After passing through the radiator the working fluid continues to circulate through the first loop and returns to the reservoir where it is reheated. The temperature of the fliud will steadily fall from the reservoir storage temperature due to cooling in the radiator as well as admixture with the cold previously circulating working fluid. By appropriate design of the reservoir capacity, the storage temperature of the working fluid in the reservoir relative to the capacity of the radiator, the flow rate of working fluid in the first loop and other pertinent design factors, the radiator can be substantially defrosted in most cases in a single pass of the heated working fluid from the reservoir through the radiator. Nonetheless, so long as the working fluid temperature is above 32° F. it will continue to melt frost build up on the radiator. By storing the fluid in the reservoir at a sufficiently high temperature several useful passes of the stored volume of liquid through the radiator may be obtained before the fluid temperature in the first loop again falls below 32° F., and no further defrosting takes place.

Operation of the vaporizer is not interrupted during the defrosting cycle. It will be appreciated that the heater is utilized in an efficient manner in that no attempt is made to bring up the temperature of the normally circulating working fluid from its relatively low working temperature. Instead, a thermal reserve is built-up in the reservoir by keeping a volume of working fluid at an elevated temperature, and, when necessary, discharging this heated stored liquid through the radiator, preferably with a minimum of mixing with the cold circulating working fluid. In this manner, rapid defrosting of the radiator is achieved with minimum energy input and without disruption of the vaporizer operation.

The vaporizer desirably further comprises a second working fluid loop which includes a second heater for heating the working fluid circulating through the second loop, and a second heat exchanger wherein the gasified output of the first heat exchanger may be further raised in temperature by the heated working fluid. The gas output of the vaporizer may be brought to a temperature above that of the ambient air, again in an energy effective manner since only a relatively small amount of heat is added in the second loop, and as much as 60 to 80 percent of the total heat input to the cryogen is drawn from ambient air through the radiator in the first loop.

In an alternate embodiment, the cryogen vaporizer comprises a first loop in which a working fluid flows through a radiator where the fluid absorbs heat from ambient air. The working fluid is then circulated through a first heat exchanger in which the working fluid transfers heat to a cryogen such as liquid nitrogen. The vaporizer also includes a second loop or circuit wherein a working fluid is heated by means such as an electric heater. The heated working fluid in the second loop is circulated through a second heat exchanger where additional heat is transferred to the now gasified cryogen output of the first heat exchanger. The second loop is therefore capable of raising the temperature of the gas to a temperature higher than that of the ambient air. The vaporizer further includes conduits and valves for temporarily disconnecting the heater from the second loop and inserting the heater into the first loop to heat the working fluid in the first loop, for defrosting the radiator when excessive frost build-up has occurred. In this alternate embodiment vaporization of the cryogen is halted during the defrosting cycle. After defrosting is completed the heater is disconnected from the first loop and returned to the second loop and operation of the vaporizer resumes. In a variant of this alternate embodiment, instead of heating the fluid in the first loop the circulating heated working fluid of the second loop may be diverted to the radiator for melting frost build-up on the radiator. This is accomplished by connecting the radiator into the second loop while temporarily stopping circulation of fluid in the first loop.

In a presently preferred construction of this alternate embodiment, the heater device can be inserted by means of suitable valving either into the primary or radiator heat exchanger loop or into the secondary or heated loop. In a normal operating condition of the vaporizer, liquid nitrogen is first placed in thermal contact in a first heat exchanger with the working fluid of the primary loop. The liquid nitrogen is heated sufficiently by the primary loop to pass to the gaseous state. Subsequently, depending on ambient air temperature and the desired temperature of the nitrogen gas output of the vaporizer, the nitrogen gas may be placed in thermal contact with a working fluid in the secondary loop by means of a second heat exchanger. The secondary loop includes a heater, such as an electric resistance heater for heating the working fluid in the second loop, the working fluid in turn heating the nitrogen gas in the second heat exchanger.

In colder climates, it will be desirable to operate the heater in the secondary loop in order to elevate the temperature of the nitrogen gas output above the temperature of the ambient air. It is precisely in such climates where frosting of the radiator will occur. Under such circumstances the heater is normally connected in the secondary loop for maintaining the working fluid of the secondary loop at a predetermined temperature, so as to obtain the desired nitrogen gas output temperature. Periodically, as may be necessary given the ambient air temperature, humidity conditions, etc . . . , the heater is connected by means of suitable valves into the primary working fluid loop and disconnected from the secondary working fluid loop. The heater then operates to raise the temperature of the working fluid passing through the radiator, thereby raising the temperature of the radiator outer skin until the accumulated frost melts. The heater can thus function in one of two capacities, i.e., heating the nitrogen gas in the secondary loop if sufficient heat is not available from ambient air to obtain a satisfactory gas output temperature from the first heat exchanger, or to defrost the radiator so as to enable sustained, long term operation of the air heated primary loop of the vaporizer.

DETAILED DESCRIPTION OF THE INVENTION

Figure 1:
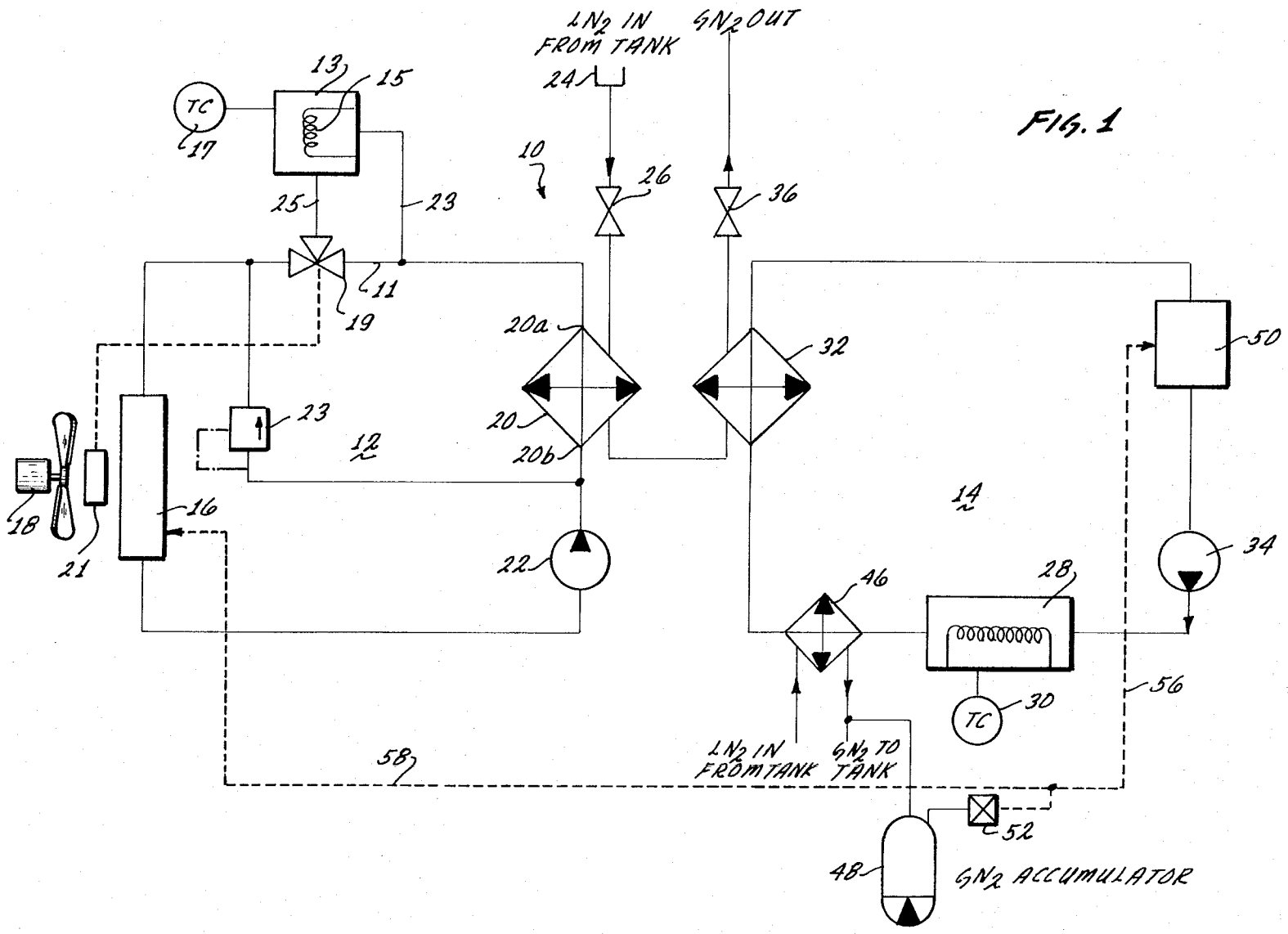
FIG. 1 is a schematic diagram of a cryogen vaporizer constructed according to the presently preferred embodiment of the invention.

In the presently preferred embodiment illustrated in FIG. 1 of the drawings, the cryogen vaporizer 10 has a first working fluid loop 12 which includes a radiator 16 connected by means of suitable conduits to a first heat exchanger 20 and a pump 22. The radiator 16 may be of conventional design for effecting a heat exchange between the atmosphere and a working fluid, e.g. a water-ethylene glycol mixture, circulating through conduits in the radiator structure. A flow of ambient air may be generated by an fan 18 positioned for directing a stream of air through the radiator. The heat exchanger 20 may typically consist of two coaxial tubes wound into a coiled structure. The heat exchanger coil has an outer tube for carrying the working fluid and an inner tube coaxial with the outer tube for carrying the cryogen in counter-flow to the working fluid such that a heat exchange takes place through the wall of the inner tube. A cryogen such as liquid nitrogen is admitted through inlet 24 and inlet valve 26 into the inner or lesser diameter tube of the heat exchanger coil 20. The outer tube, i.e., the tubing of larger diameter in such a heat exchanger coil is connected through suitable conduits to the radiator 16 and the pump 22 to define the primary loop 12 of the vaporizer. One or more such heat exchanger coils may be connected in parallel or in series.

A thermally well insulated reservoir 13 is connected to the first loop upstream of the radiator 16. The reservoir is provided with a relatively low power heater element 15, which may be an electric resistance heater connected to a suitable source of electrical power. A volume of working fluid is stored in the reservoir 13 and maintained at an elevated temperature by means of the heater 15 and controlled by means of temperature control 17. The reservoir 13 is connected in series with the heat exchanger 20 and the radiator 16, but is shunted by a section of conduit 11. In normal vaporizer operation, a three-way valve 19 is set so as to close liquid flow through the reservoir 13, such that the working fluid in loop 12 flows from the outlet 20*a* of the first heat exchanger 20 through conduit section 11, valve 19, and the radiator 16, bypassing the reservoir 13. The working fluid in reservoir 13 is stored at a predetermined elevated temperature but is not used in normal vaporizer operation. The working fluid normally circulating in loop 12 is cold, e.g., −38° F. at the outlet 20*a* of heat exchanger 20 and −19° F. at the radiator outlet.

If defrosting of the radiator 16 becomes necessary, the three-way valve 19 is actuated so as to close liquid flow through the shunt conduit 11 and open the conduit 25. The pump 22 which normally circulates the working fluid through the loop 12 now forces the working fluid into the reservoir 13 through inlet conduit 23, thereby expelling the stored heated working fluid from the reservoir through outlet conduit 25. The heated fluid flows into the radiator 16, heating the fluid conduits in the radiator to melt frost build-up on the outer skin of the radiator.

In an actual device constructed according to this specification, the radiator 16 has a capacity of 50 to 70 gallons of working fluid while the entire primary loop 12 including the radiator 16, heat exchanger 20 and interconnecting conduits hold approximately 150 gallons of working fluid. The reservoir 13 has a capacity of 200 gallons of working fluid and the stored working fluid is kept at approximately 80° F. The heater 15 is a 50–60 kw electric heater. Once the fluid in the reservoir 13 is brought up to the desired storage temperature, which can be accomplished in approximately 5–10 minutes, the heater is turned off by temperature control 17 and thereafter operates for very brief intervals to make up for heat loss from the reservoir, so that stand-by power consumption is minimal. The pump 22 is a positive displacement pump with a capacity of 400 gallons per minute. Thus, when the three-way valve 19 is actuated to open flow through the reservoir 13 the heated stored liquid can flow through the radiator 16 in approximately 30 seconds, rapidly raising the temperature of the radiator conduits. The hot liquid then passes through the pump 22 and heat exchanger 20 where its heat is used to vaporize cryogen which continues to flow without interruption through the heat exchanger during the defrosting cycle. The temperature of the hot working fluid after discharge from the reservoir 13 will drop due to loss of heat both in the radiator and the heat exchanger, and also through admixture with the cold working fluid originally circulating in the loop 12. The heated working fluid then returns to the reservoir 13 to close the loop, where it is again heated by the heater 15. The heat input delivered by heater 15 is insufficient to maintain the temperature of the working fluid in the loop 12 but merely serves to delay the drop of the fluid's temperature below a point where no further deicing takes place. During the defrost cycle any given volume of the working fluid remains in the reservoir 13 average of 30 seconds due to the flow rate of the pump 22, which time is too short for the liquid to be reheated to its original storage temperature given the relatively low power of the heater 15. As the working fluid completes additional circuits through the loop 12, its temperature will gradually continue to drop, but defrosting of the radiator continues so long as the working fluid temperature is above the freezing temperature of the moisture condensed on the outer skin of the radiator. It is estimated that the heat of the working fluid stored in the reservoir 13 suffices under most circumstances to defrost the radiator 16 in approximately 1 minute. The fan 18 may be stopped during defrosting to conserve heat in the radiator.

The three-way valve 19 may be manually operated when desired or an automatic valve may be used and controlled by means of a pressure sensor 21 installed so as to sense an increase in the air pressure of the air stream directed by the fan 18 through the radiator 16. As the radiator begins to ice up, the accumulation of frost restricts the free passage of air through the radiator resulting in an increase in air pressure. This pressure increase is sensed by sensor 21 which is connected so as to actuate the three-way valve 19 thereby to release through the radiator the heated working fluid stored in reservoir 13.

It is further desirable to connect a pressure relief valve 23 at least across the heat exchanger 20 and preferably across both the heat exchanger 20 and the reservoir 13 including the valve 19 as shown in FIG. 1. The purpose of the pressure relief valve 13 is to allow working fluid to bypass the the heat exchanger 20 in the event that icing of the working fluid occurs at the cryogen inlet 20*a* to the heat exchanger due to the very low temperature of the cryogen in that area.

A further improvement consists in the pressurization of the first loop to avoid cavitation in the pump 22. Cavitation may occur because of the desirably high flow rate of the working fluid in the loop 12. The high flow rate is significant because it allows liquid to transfer sufficient heat from the radiator to the heat exchanger while minimizing the temperature drop across the walls of the radiator conduits carrying the working fluid. The relatively small temperature differential across the radiator skin reduces the frost build-up on the radiator without diminishing the capacity of the vaporizer. At high flow rates cavitation becomes a problem. It has been found that by pressurizing the loop 12 cavitation is minimized or eliminated. The pressure, which may be 10–15 p.s.i., can be conveniently obtained by connecting the top of the radiator 16 to a regulated source of pressure, such as an accumulator 48 pressurized by nitrogen gas produced by the vaporizer.

In order to raise the temperature of the gas output of the first heat exchanger 20 above ambient temperature, a second working fluid loop 14 is provided which includes a second heat exchanger 32, a working fluid heater 28 and a pump 34 and a sump 50 interconnected by suitable conduits. Working fluid is continuously circulated by pump 34 through the heater 28 which may be an electrical resistance heater connected to a suitable source of electrical power. The heater 28 and temperature regulator 30 keep the temperature of the working fluid in the second loop at a predetermined temperature, e.g., 65° F., as the heated working fluid flows through the second heat exchanger 32 which may be similar in structure to the first heat exchanger 20. The gas output of the first heat exchanger flows through the second heat exchanger and is raised in temperature before being delivered through the output valve 36 for storage in a suitable container or for any desired immediate use. The sump 50 is preferably also pressurized to, e.g., 10–15 p.s.i. to avoid cavitation of the working fluid in the pump 34 at high rates of flow. The pressure for the sump is derived from an accumulator 48 and pressure regulator 52 as indicated by the connection in 56 shown in dotted lines. A similar connection 58 also in dotted lines, is shown from the pressure regulator 52 to the radiator 16 for pressurizing the first working fluid loop 12 as was explained earlier.

The second loop 14 may include a third heat exchanger 46 in which a relatively small amount of cryogen is vaporized by thermal contact with the working fluid of the second loop. The resulting gas may be used to pressurize the cryogen tank (not shown in the drawings) which supplies the cryogen to the first heat exchanger, thus eliminating the need for pumps to deliver the cryogen to the vaporizer. The gas output of the third heat exchanger may be also stored under pressure in an accumulator 48 equipped with a pressure regulator 52 to provide a source of regulated pressure for the first and second loops as has been described.

Figure 2:
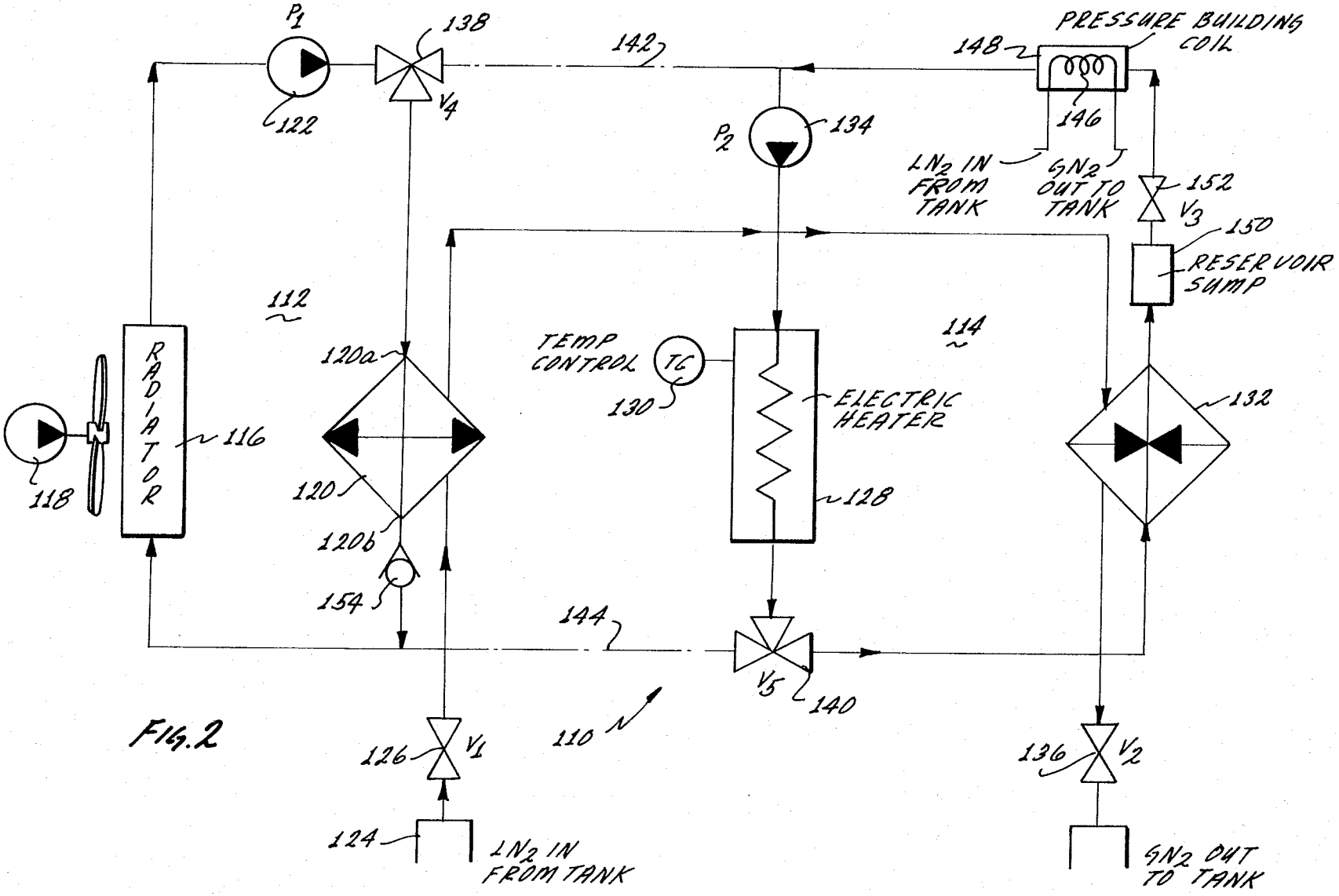
FIG. 2 is a schematic diagram of a cryogen vaporizer constructed according to an alternate embodiment of the present invention.

The working fluid in both tthe first and second loops, as well as that stored in the reservoir 13 may be a mixture of 60% ethylene glycol and 40% water which has a freezing point of −60° F. With reference to FIG. 2 of the drawing, an alternate nitrogen vaporizer 110 is shown which generally includes a primary loop 112 and a secondary loop 114. The primary loop 112 comprises a radiator 116 of conventional design for effecting a heat exchanger between a first working fluid circulating through conduits in the radiator structure, and a flow of ambient air which may be generated by a fan 118 positioned and constructed for directing a stream of air through the radiator. The primary loop 112 also includes a first heat exchanger 120. The heat exchanger 120 may typically consist of a pair of coaxial tubes would into a coiled structure. The heat exchanger 120 may comprise more than one such heat exchanger coil connected in parallel or in series. The outer tube, i.e., the tubing of larger diameter in such a heat exchanger coil is connected through suitable conduits to the radiator 116 and a pump 122 to define the primary loop of the vaporizer 110. Liquid nitrogen is drawn from a suitable storage tank or other source and admitted through inlet 124 and inlet valve 126 into the inner or lesser diameter tube of the heat exchanger coil 120. The cryogen is thus placed in heat exchanging contact through the wall of the inner heat exchanger tube with the working fluid circulating through the space between the inner and outer tube walls.

The secondary loop 114 of the vaporizer 110 includes an electric heater 128 of the type having an electrical resistance heater element connected to a source of electrical power. The operation of the heater 128 may be controlled by means of a suitable temperature control 130 mounted for sensing the temperature of a fluid circulating through the heater 128. The heater 128 is connected by suitable conduits to a second heat exchanger 132 which may be constructed in a manner similar to that described in connection with the first heat exchanger 120. A working fluid is circulated through the loop 114 by a second pump 134 so that the working fluid circulates through the heater 128 where its temperature is raised and then flows through the heat exchanger 132 where it is placed into heat exchanging contact with nitrogen gas flowing out of the first heat exchanger 120. The cryogen thus enters through inlet valve 126, flows into the first heat exchanger 120 where it is vaporized, and is then conducted through the second heat exchanger 132 where its temperature may be further elevated, if desired, by the heater 128 via the working fluid loop 114. The gas output of the second heat exchanger 132 flows out of the vaporizer through an outlet valve 134 from where it may be directed to a storage tank or other destination. The primary loop 112 and the secondary loop 114 of the vaporizer are interconnected by a pair of conduit lines 142 and 144 shown in dotted lines, but which in normal operation of the vaporizer are closed by means of three-way valves 138 and 140 such that no exchange of working fluid takes place between the loops 112 and 114.

The heater 128 may be placed in operation if it is desired to supplement the heat available from ambient air. Otherwise the heater 128 may be left inoperative and the gas output of the first heat exchanger 120 passed through the second heat exchanger 132 without additional heating taking place in the second heat exchanger. Preferably the second loop 114 further includes a container through which is circulated the working fluid of the secondary loop and a pressure building coil 146 submerged in the working fluid passing through the vessel 148. Liquid nitrogen from the tank supplying the liquid nitrogen flow into the vaporizer through inlet valve 126. The liquid nitrogen is vaporized in the pressure building coil which is heated by the flow of working fluid and the nitrogen gas output of the pressure building coil is returned to the tank for pressurizing the tank and heating the liquid nitrogen from the tank to the vaporizer inlet 124. The secondary loop is also provided with a sump 150 which holds a reserve supply of working fluid, and a valve 152 for closing fluid flow through the second heat exchanger 132 for a purpose that will be explained below.

It will be understood that the pumps 122 and 134 and the motor driven fan 118 should be connected to a suitable source of power, e.g., an electrical power supply through suitable switches and controls.

In the event of excessive frost build-up on the radiator 116, the defrosting procedure is as follows. The two pumps 122 and 134 are preferably shut down to avoid cavitation or possible damage to the conduits. The three-way valves 138 and 140, which may be manually operated valves, are moved from their normal positions in which the conduits 142 and 144 are closed, to a defrosting position in which the conduits 142 and 144 connect the heater 128 to the radiator 116. Valve 138 closes the line normally connecting pump 122 to the inlet side **120*a* of heat exchanger 120 while valve 140 closes the conduit leading to the inlet of heat exchanger 132. The valve 152, which is normally open, is closed to stop fluid flow into the sump 150 and the second heat exchanger 132. One or both of the pumps 122 and 134 may be now restarted. The new conduit interconnections in the defrosting mode of the vaporizer divert working fluid in the first loop 112 through pump 134 and heater 128 in the secondary loop and then through three-way valve 140 and conduit 144 to the radiator 116. The working fluid heated by the heater 128 flows through the radiator, raising the skin temperature of the radiator to melt frost build-up on the radiator skin. The working fluid then flows through pump 122 and conduit 142 and is returned through pump 134 to the heater 128. The working fluid is prevented from branching into the second heat exchanger 132 by the now closed valve 152. The working fluid is further prevented from entering the first heat exchanger 120 through its outlet end 120*b* by check valve 154**.

Once defrosting of the radiator 116 has been completed, the vaporizer is returned to its normal mode of operation by shutting down the pumps 122, 134, returning three-way valves 138 and 140 to their normal operating positions, opening valve 152 and restarting the pumps 122, 134. If desired, the fan 118 may be stopped during defrosting to avoid unnecessary waste of heat needed for melting the frost.

The vaporizer includes an cryogen inlet shut-off valve 26 in FIG. 1 and 126 in FIG. 2 which may be adjusted so as to regulate the inflow of liquid cryogen to the vaporizer. The outlet valve 36 in FIG. 1 and 136 is adjusted by the user of the vaporizer to regulate the flow of the gas output of the vaporizer as needed.

From the foregoing, it will be appreciated that a novel cryogen vaporizer has been disclosed which provides for maximum utilization of a limited source of energy, such as a limited amount of electrical power, in a cryogen vaporizer capable of sustained operation during extended periods of time for producing a large volume of gas from a cryogen input.

An important feature of the novel vaporizer is the use of a working fluid loop for carrying heat from ambient air to the cryogen. This makes possible a very large reduction in the temperature drop across the skin of the radiator. In prior cryogen vaporizers heated by ambient air, the temperature drop at the heat exchanger was substantially the difference between ambient air temperature and cryogen temperature. As was earlier explained, this accelerated the formation of frost such that the vaporizer could only be utilized for brief intervals and required very considerable quantities of energy for defrosting of the heat exchanger surfaces exposed to the ambient air. In the present vaporizer, the temperature drop at the radiator is considerably reduced and typically may be 60° F. compared to typical temperature drops of 275° F. in known ambient air heated vaporizers which lack an intermediate working fluid. The relatively low temperature differential between ambient air and working fluid at the radiator may be minimized by pumping the working fluid at large flow rates through the radiator 116 and the heat exchanger 120 so that the temperature of the working fluid does not drop excessively through the first heat exchanger 120, yet large quantities of heat are carried to the heat exchanger by the heavy flow of working fluid through the primary loop 112. In a basic embodiment of the invention, the second heat exchanger 132, the pump 134 and associated components of the secondary loop 114 may be omitted, such that the cryogen is heated only in heat exchanger 120 and the heater 128 may be inserted into the loop 112 by values 138, 140 and conduits 142, 144 as needed for defrosting the radiator.

It will be understood that many alterations and modifications to the presently preferred and alternate embodiments described above may be made by those having ordinary skill in the art without departing from the spirit and scope of the invention. Therefore, the presently illustrated embodiment has been shown only by way of example and for the purpose of clarity, and should not be taken to limit the scope of the following claims. It will be further understood that the valving and interconnections shown in the drawing may be altered in various ways without departing from the invention. For example, in the alternate embodiment of FIG. 2, the working fluid of the secondary loop 114 which may be at a normally elevated operating temperature due to the heater 128, may be diverted to the radiator 116 during the defrosting cycle, rather than diverting the working fluid from the primary loop 112 for heating through the heater 128 as was earlier described. In normal vaporizer operation, no exchange or intermixing of working fluids occurs between the primary loop 112 and secondary loop 114. When switching the valving over to the defrosting cycle, some intermixing of working fluid may occur due to fluid present in the shared conduits. Such intermixing is of no consequence since it is contemplated that the same working fluid, e.g., a glycol-water mixture may be used for both vaporizer loops.

We claim:

1. A cryogen vaporizer comprising:

a radiator for placing a first working fluid in heat exchanging contact with ambient air;

a first heat exchanger for placing a cryogen in heat exchanging contact with said first working fluid to thereby vaporize said cryogen;

means defining a first loop for circulating said first working fluid through said radiator and said first heat exchanger;

reservoir means for storing a quantity of working fluid;

heater means for heating working fluid stored in said reservoir means;

conduit means connecting said reservoir to said first loop; and normally closed valve means actuatable for releasing heated working fluid stored in said reservoir through said conduit means into said first loop to thereby defrost said radiator.

2. The cryogen vaporizer of claim 1 further comprising:

a second heat exchanger for placing working fluid in heat exchanging contact with the vaporized cryogen output of said first heat exchanger;

means defining a second loop for circulating the working fluid through said heater second heat exchanger; and second heater means for heating working fluid in said second loop thereby to further heat the vaporized cryogen in said second heat exchanger.

3. The cryogen vaporizer of claim 1 further comprising pressure relief valve means connected between the working fluid input to said first heat exchanger and the working fluid inlet to said radiator.

4. The cryogen vaporizer of claim 1 further comprising first pump means for pumping working fluid through said first loop and means for pressurizing said radiator to thereby avoid cavitation in said pump means.

5. The cryogen vaporizer of claim 4 wherein said means for pressurizing include pressure accumulator means connected to a source of vaporized cryogen, and means connecting said accumulator means to said radiator.

6. The cryogen vaporizer of claim 1 wherein said heater means comprise an electric heater.

7. The cryogen vaporizer of claim 1 wherein said radiator means include fan means for directing a stream of air through said radiator.

8. The cryogen vaporizer of claim 7 further comprising pressure sensor means for sensing the air pressure of the air stream through said radiator and means for actuating said valve means responsive to an increase in pressure in said air stream.

9. The cryogen vaporizer of claim 1 wherein said heater means is an electrically powered heater.

10. The cryogen vaporizer of claim 1 further comprising a pressure building coil heated by the working fluid in said second loop.

11. The cryogen vaporizer of claim 1 further comprising pump means for circulating the working fluid in said first and second loops.

12. The cryogen vaporizer of claim 1 further comprising fan means for directing a stream of ambient air onto said first means.

13. The cryogen vaporizer of claim 1 wherein actuation of said normally closed valve means is operative for inserting said reservoir into said first loop.

14. A cryogen vaporizer comprising:

a first loop including a radiator for placing a working fluid in heat exchanging contact with ambient air;

a first heat exchanger for placing said working fluid in heat exchanging contact with a cryogen to obtain a gas output;

means for circulating said working fluid in a first closed loop between said radiator and said first heat exchanger;

a second loop normally unconnected to said first loop, said second loop including heater means for heating a working fluid;

a second heat exchanger for placing the gas output of said first heat exchanger in heat exchanging contact with said heated fluid;

means for normally circulating said working fluid in a second closed loop between said water means and said second heat exchanger; and valve means for temporarily connecting said heater means and said radiator in a closed loop such that heated, working fluid is circulated for defrosting said radiator.

15. A method for vaporizing a cryogen comprising the steps of:

circulating a first working fluid in heat exchanging contact with ambient air in a radiator;

placing the working fluid in heat exchanging contact with a cryogen to be vaporized;

heating a second working fluid in a heater;

normally placing said second heated working fluid in heat exchanging contact with the vaporized cryogen;

interrupting the steps of circulating, placing, heating and normally placing;

temporarily interconnecting the fluid conduits of the radiator and the heater;

circulating working fluid through the radiator and the heater to melt frost build-up on the radiator;

disconnecting said heater from said radiator; and resuming said steps of circulating, placing, heating and normally placing.

16. A cryogen vaporizer comprising:

a radiator for placing a first working fluid in heat exchanging contact with ambient air;

a first heat exchanger for placing a cryogen in heat exchanging contact with said first working fluid to thereby vaporize said cryogen;

means defining a first loop for circulating said first working fluid through said radiator and said first heat exchanger;

reservoir means for storing a quantity of working fluid;

heater means for heating working fluid stored in said reservoir means;

conduit means connecting said reservoir to said first loop;

normally closed valve means actuatable for releasing heated working fluid stored in said reservoir through said conduit means into said first loop to thereby defrost said radiator;

a second heat exchanger for placing working fluid in heat exchanging contact with the vaporized cryogen output of said first heat exchanger;

means defining a second loop for circulating the working fluid through said heater second heat exchanger; and second heater means for heating working fluid in said second loop thereby to further heat the vaporized cryogen in said second heat exchanger.

17. A method for vaporizing a cryogen comprising the steps of:

placing a working fluid in heat exchanging contact with ambient air in a radiator;

placing said working fluid in heat exchanging contact with a flow of cryogen in a first heat exchanger to thereby vaporize said cryogen;

circulating said working fluid through said radiator and said first heat exchanger in a closed loop;

storing a volume of working fluid in a reservoir;

maintaining said stored working fluid at a temperature above 320 degrees F.; and discharging said heated working fluid through said radiator to defrost the radiator.

18. The method of claim 17 further comprising the steps of heating a working fluid in a second closed loop and placing said vaporized cryogen in heat exchanging contact with said working fluid to thereby further raise the temperature of said vapor.

19. The method of claim 17 further comprising the step of pressurizing said working fluid by means of vaporized cryogen to prevent cavitations in said loop.

20. A method for vaporizing a cryogen comprising the steps of:

placing a working fluid in heat exchanging contact with ambient air in a radiator;

placing said working fluid in heat exchanging contact with a flow of cryogen in a first heat exchanger to thereby vaporize said cryogen;

circulating said working fluid through said radiator and said first heat exchanger; and heating a working fluid in a second closed loop and placing said vaporized cryogen in heat exchanging contact with said working fluid to thereby further raise the temperature of said vapor.

21. The method of claim 20 further comprising the step of pressurizing said working fluid in both said first and second loops to prevent cavitation of said fluid.

* * * * *